US010822158B2

(12) United States Patent
Benzinger et al.

(10) Patent No.: US 10,822,158 B2
(45) Date of Patent: Nov. 3, 2020

(54) PACKAGING CONTAINER FOR AN ELONGATE OBJECT SUCH AS A MILLING CUTTER, DRILL BIT OR THE LIKE

(71) Applicant: vhf tools AG, Ammerbuch (DE)

(72) Inventors: Frank Benzinger, Ammerbuch (DE); Matthias Schumacher, Calw-Stammheim (DE)

(73) Assignee: vhf tools AG, Ammerbuch (DE)

( * ) Notice: Subject to any disclaimer, the term of this patent is extended or adjusted under 35 U.S.C. 154(b) by 196 days.

(21) Appl. No.: 16/141,090

(22) Filed: Sep. 25, 2018

(65) Prior Publication Data

US 2019/0092561 A1 Mar. 28, 2019

(30) Foreign Application Priority Data

Sep. 28, 2017 (DE) ..... 10 2017 009 135

(51) Int. Cl.

| | |
|---|---|
| ***B65D 85/20*** | (2006.01) |
| ***B25H 3/00*** | (2006.01) |
| ***B65D 25/10*** | (2006.01) |
| ***B65D 21/02*** | (2006.01) |

(52) U.S. Cl.

CPC ..... *B65D 85/20* (2013.01); *B25H 3/003* (2013.01); *B65D 21/0204* (2013.01); *B65D 25/101* (2013.01)

(58) Field of Classification Search

CPC .... B65D 21/02; B65D 21/0204; B65D 25/10; B65D 25/101; B65D 85/20; B65D 85/24; B65D 85/28; B65D 85/38; B25H 3/003

USPC ..... 206/349–379, 446; 220/4.26, 4.27, 23.2, 220/23.4, 23.8

See application file for complete search history.

(56) References Cited

U.S. PATENT DOCUMENTS

| | | | | |
|---|---|---|---|---|
| 3,862,683 | A * | 1/1975 | Koelichen | B43M 99/007 220/23.4 |
| 5,044,804 | A * | 9/1991 | Chuang | B43K 23/06 401/34 |
| 5,595,294 | A * | 1/1997 | McKenzie | B25H 3/021 206/349 |
| 5,649,638 | A * | 7/1997 | Roy | F42B 3/02 220/23.4 |
| 6,047,827 | A * | 4/2000 | Huang | B25H 3/003 206/349 |
| 7,677,390 | B2 * | 3/2010 | Roesler | B65D 25/101 206/379 |
| 8,079,487 | B2 * | 12/2011 | Roesler | B25H 3/023 206/349 |
| 8,397,931 | B2 * | 3/2013 | Palmer | A45D 40/18 220/4.27 |
| 8,985,327 | B2 * | 3/2015 | Roesler | B65D 25/103 206/379 |

(Continued)

*Primary Examiner* — Bryon P Gehman
(74) *Attorney, Agent, or Firm* — Gudrun E. Huckett

(57) ABSTRACT

A packaging container for an elongate object has a base and a protective sleeve to be pushed in a direction of a longitudinal axis of the protective sleeve onto the base. The protective sleeve can be secured at the base. The base has a receptacle for an end of an elongate object and the protective sleeve covers an elongate object received in the receptacle. The packaging container has a primary part of a first external coupling device and the primary part is detachably connectable to a secondary part of a second external coupling device that is provided on a further packaging container.

18 Claims, 13 Drawing Sheets

(56) References Cited

U.S. PATENT DOCUMENTS

| | | | | |
|---|---|---|---|---|
| 2006/0283769 | A1 | 12/2006 | Roesler | |
| 2008/0185305 | A1 | 8/2008 | Roesler | |
| 2009/0321436 | A1* | 12/2009 | Higgs ..... | B65D 61/00<br>220/23.4 |

* cited by examiner

PACKAGING CONTAINER FOR AN ELONGATE OBJECT SUCH AS A MILLING CUTTER, DRILL BIT OR THE LIKE

BACKGROUND OF THE INVENTION

The invention relates to a packaging container for an elongate object, in particular for a tool such as a drill bit, milling cutter, or a similar tool. The packaging container is comprised of a base and a protective sleeve that can be pushed in the direction of the longitudinal axis of the protective sleeve onto the base and is held at the base. The base comprises a receptacle for an end of the elongate object, wherein the protective sleeve covers the length of the elongate object and protects it.

Packaging containers of this kind are known. US 2006/0283769 discloses a packaging container whose base extends across the entire length of the protective sleeve. A tool is placed into an insertion section of the base and then the protective sleeve is pushed across the insertion section. A similar packaging is disclosed in US 2008/0185305.

When several tools must be held available in packaging containers, they are usually placed into receptacles or the like. This is not expedient and can easily lead to the individual packaging containers being lost.

The invention has the object to configure a packaging container for an elongate object such that it can be stored together with other packaging containers of the same configuration in a simple way and made available at a machine tool.

SUMMARY OF THE INVENTION

According to the invention, this object is solved by a packaging container provided with a primary part of an external coupling device which is configured for detachable connection with a secondary part of an external coupling device of another packaging container. In this way, it is achieved that two identically configured packaging containers can be connected to each other by the coupling device. According to the invention, it is thus possible to fixedly connect several packaging containers to each other, advantageously in a row, so that a safe storage and a simple practical handling is possible.

The packaging container according to the invention is configured such that it supports at a first longitudinal side the primary part of the coupling device and at a different second longitudinal side the secondary part of the coupling device. Expediently, the first longitudinal side and the second longitudinal side are positioned parallel to each other and in particular opposite each other in alignment for connecting two packaging containers.

In a first embodiment of the packaging container, it is provided that the primary part and the secondary part of the coupling device are provided exclusively at the protective sleeve. In this context, a length section of the primary part of the coupling device and/or a length section of the secondary part of the coupling device can extend across more than 30% of the length of the protective sleeve. In particular, the length section of the primary part and/or the length section of the secondary part extends in their length direction across the entire length of the protective sleeve.

In a further embodiment of the packaging container, it is advantageously provided to embody a second length section of the primary part and/or a second length section of the secondary part of the coupling device at the base. This second length section can be a supplemental length section of the primary part and/or of the secondary part at the protective sleeve or can be provided as a single length section of the primary part and/or of the secondary part only at the base. In a particular embodiment of the invention, it is provided that the primary part and/or the secondary part extends across the entire length of the packaging container. The coupling device comprised of a primary part and a secondary part extends across the entire length of the packaging container.

In a simple configuration of the invention, the coupling device is embodied as a sliding connection which is acting in the direction of the longitudinal axis of the protective sleeve. Such a sliding connection enables a simple threading of two packaging containers across primary part/secondary part of the coupling device in longitudinal direction of the packaging container and provides a safe securing action when insertion is complete. In particular, the sliding connection is embodied like a groove/sliding block connection or a dovetail connection.

In an advantageous further embodiment of the invention, it is provided that the protective sleeve locks at the base. Expediently, at the base a locking tongue with a locking element is provided for this purpose wherein the locking element engages in particular an inner locking receptacle of the protective sleeve.

For separating the protective sleeve from the base, the locking connection must be released. For this purpose, the locking tongue is expediently pushed down wherein, in a particular embodiment of the invention but also as an independent invention, it is provided that the locking tongue upon release of the locking element exerts a clamping force on the end of the elongate object inserted in the receptacle. Advantageously, it is provided that a tongue section of the locking tongue or an element provided as a locking tongue is acting as a clamping element on an end of the elongate object which is inserted into the receptacle. Thus, when pushing down the locking tongue, the locking element at the outer longitudinal side of the locking tongue is displaced and lifted out of the locking receptacle, while, e.g. at the other longitudinal side of the locking tongue, the clamping element, or even only a tongue section of the locking tongue, is pushed against the end of the tool held in the receptacle and exerts a clamping force on it. It is thus ensured that the tool cannot accidentally detach from the receptacle and fall out of the receptacle even when opening the packaging container in an unfavorable position.

Advantageously, it is provided that the receptacle opens into a base chamber wherein the locking tongue projects into this base chamber. One end of the locking tongue can thus act as a clamping element on the end of the elongate object inserted into the receptacle.

The base itself is formed of an insertion section provided with the receptacle and engaged by the protective sleeve and of a foot section. The locking tongue with its tongue length extends across at least a length section of the insertion section and at least a length section of the foot section. In a particular embodiment of the invention, it is provided that the locking tongue with its entire length extends across the insertion section and the foot section all the way to the base bottom.

The base is comprised of an insertion section provided with the receptacle and engaged by the protective sleeve and of a foot section wherein the outer contour of the insertion section is located within the larger outer contour of the foot section. For simple handling, it is provided that the primary part and/or the secondary part projects past the outer contour of the foot section. In this context, the base itself, in particular the foot section of the base, can be formed as a stop for the coupling device. When pushing the protective sleeve onto the insertion section of the base, the stop of the base or the foot section of the base limits the sliding movement of the protective sleeve.

Further advantageous embodiments result by any combination of the features of the aforementioned and described embodiments.

Further features of the invention result from the dependent claims, the description, and the drawing in which embodiments of the invention described in detail are illustrated.

DESCRIPTION OF THE PREFERRED EMBODIMENTS

Figure 1:
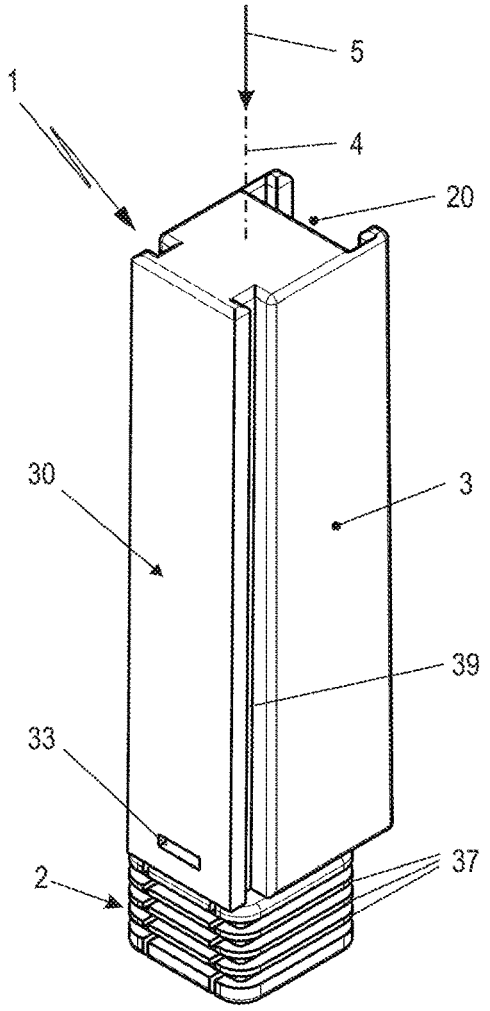
FIG. 1 is a perspective view of a packaging container, comprised of a base and a protective sleeve.

The first embodiment of a packaging container 1 illustrated in FIGS. 1 to 19 is comprised substantially of a base 2 and a protective sleeve 3. The protective sleeve 3 comprises a longitudinal axis 4. In the direction of the longitudinal axis 4, the protective sleeve 3 can be pushed in the direction of arrow 5 onto the base 2. The protective sleeve 3 is held on the base 2, preferably captively, in particular locked thereon.

The protective sleeve 3 is comprised advantageously of a transparent plastic material, in particular a colorless transparent plastic material. In this way, the contents of the packaging container 1 prior to opening it is visually recognizable easily. The base 2 is comprised advantageously of a colored plastic material. The colored, in particular translucent or opaque, plastic material can be selected such that e.g. a color coding for the tool type or tool group of the tool received in the packaging container 1 is provided.

Figure 2:
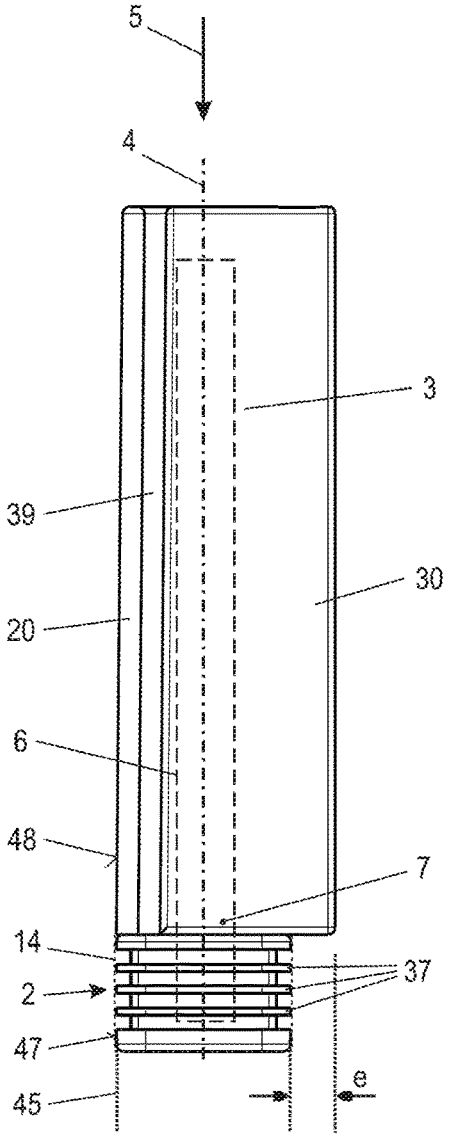
FIG. 2 is a side view of the packaging container of FIG. 1.
Figure 3:
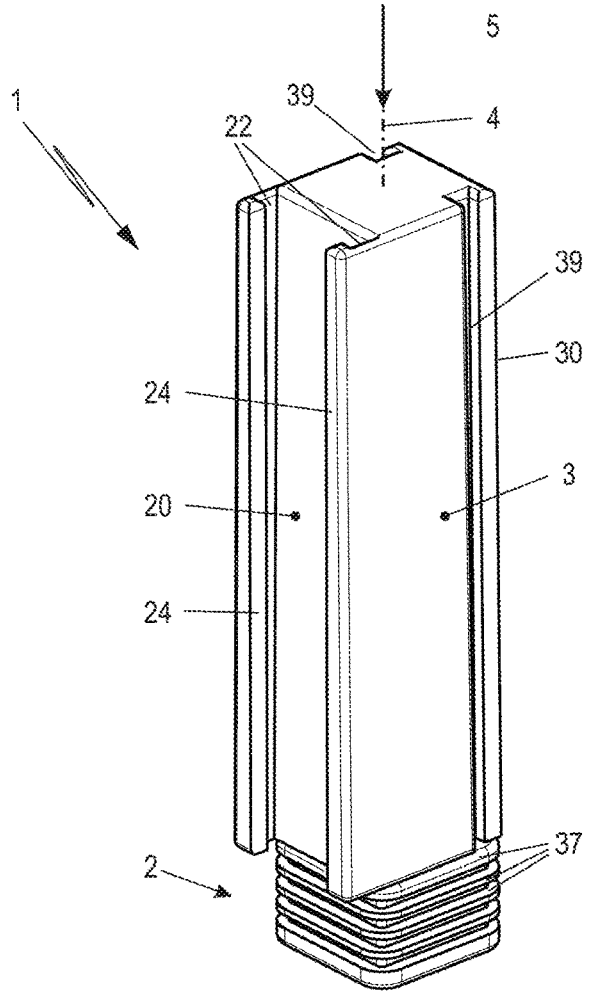
FIG. 3 is a further perspective view of the packaging container according to FIG. 1.

The base 2 serves for receiving an elongate object 6, as indicated in FIG. 2 in dashed lines. With its end 7, the elongate object 6 is inserted into a receptacle 10 illustrated in FIG. 10. The protective sleeve 3 is pushed across the elongate object 6 and pushed onto the base 2 so that the elongate object 6 is safely held and protected in the packaging container 1.

The elongate object 6 can be e.g. a milling tool, a drill bit, a thread cutter or a similar tool.

Figure 4:
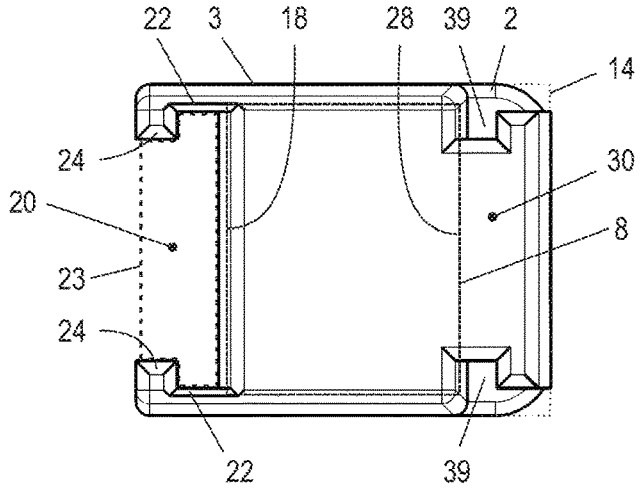
FIG. 4 is a plan view of the packaging container according to FIG. 1.
Figure 5:
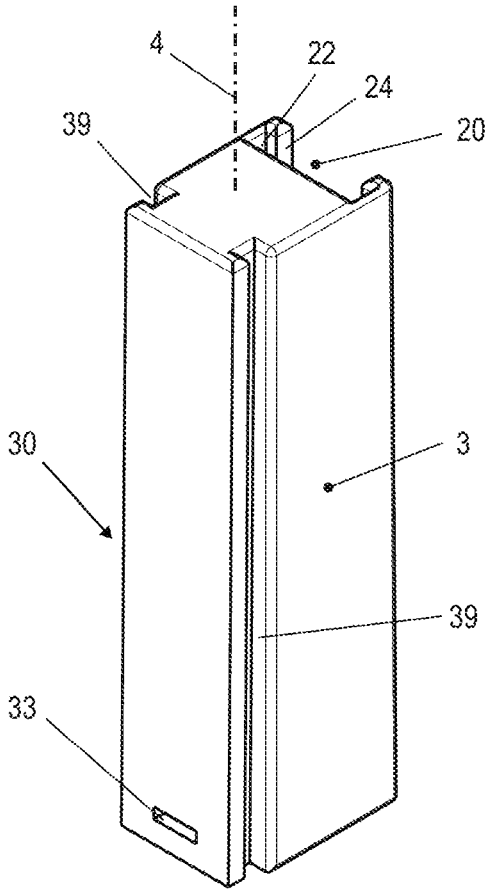
FIG. 5 is a perspective illustration of the protective sleeve of the packaging container according to FIG. 1.
Figure 6:
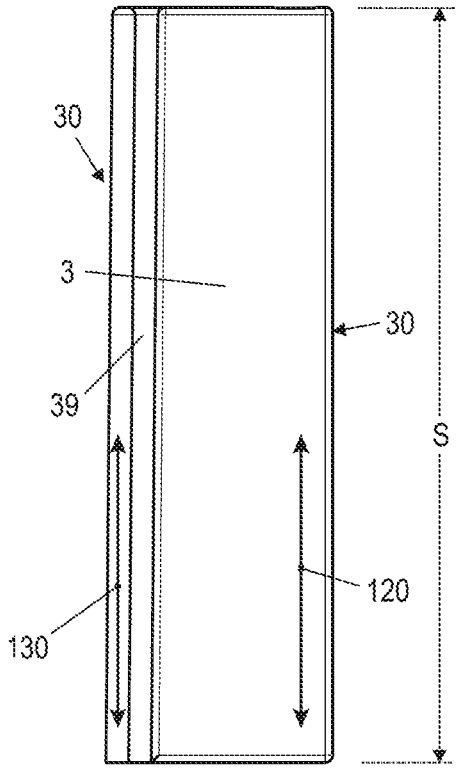
FIG. 6 is a side view of the protective sleeve according to FIG. 5.

As illustrated in FIGS. 1 to 4, the protective sleeve 3 is advantageously embodied in a rectangular shape in regard to the receiving cross section 8 (FIG. 4). In this way, two larger longitudinal sides 18 and 28 are formed that are positioned parallel to each other, as shown in FIG. 4. The longitudinal sides 18 and 28 are facing away from each other.

Figure 19:
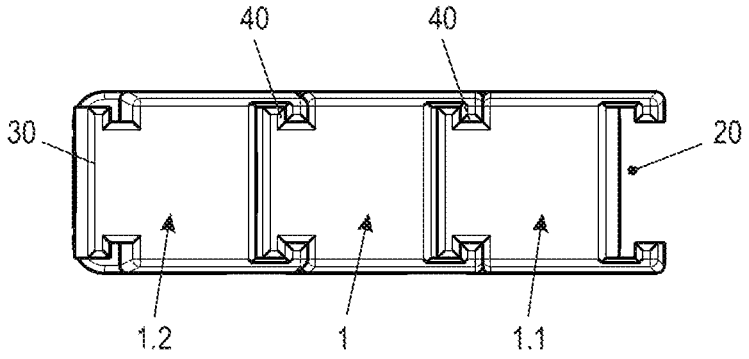
FIG. 19 is a top plan view of the row of packaging containers according to FIG. 18.

The packaging container 1 is provided, preferably at the first longitudinal side 18, with a primary part 20 that is part of an exterior coupling device 40 (FIG. 19). The other second longitudinal side 28 is provided with a secondary part 30 of the external coupling device 40. The primary part 20 forms a receptacle for a secondary part 30 of another coupling device 40. As shown in FIGS. 16 to 19, the packaging container 1 can be detachably connected to additional packaging containers 1.1 and 1.2 by means of the coupling device 40.

The protective sleeve 3 is illustrated in FIGS. 5 to 9. It comprises a rectangular receiving cross section 8 which determines the cavity 9 for receiving the elongate object 6. As shown in FIGS. 5 to 9, the primary part 20 and the secondary part 30 of the coupling device 40 are formed at the protective sleeve 3. The primary part 20 and the secondary part 30 are located on longitudinal sides 18, 28 which are facing away from each other, wherein a first length section 120 (FIG. 6) of the primary part 20 and/or a first length section 130 (FIG. 6) of the secondary part 30 of the coupling device 40 extend across more than 30% of the length S of the protective sleeve 3. In the illustrated embodiment, the primary part 20 and/or the secondary part 30 extend across the entire length S of the protective sleeve.

Figure 16:
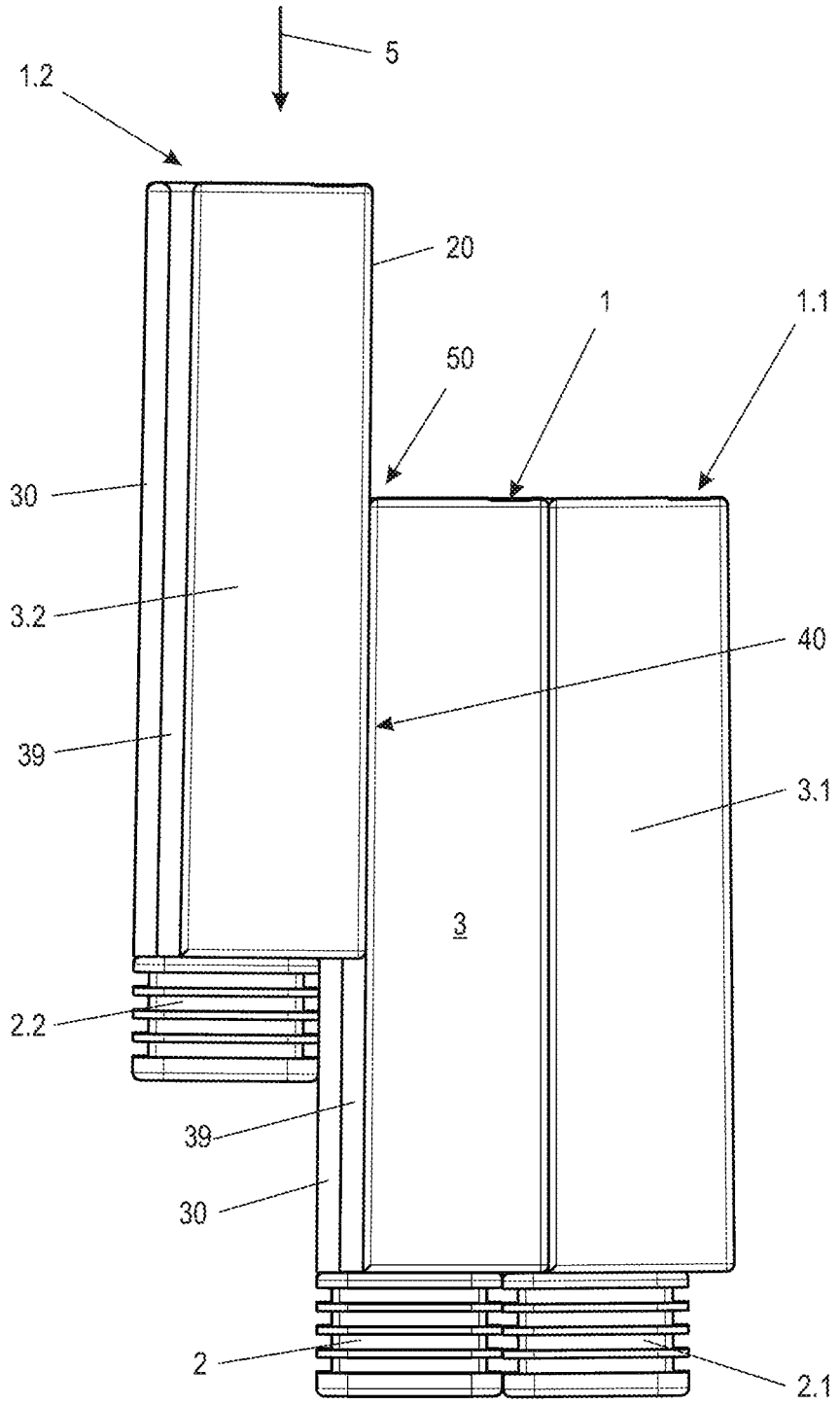
FIG. 16 is a side view of several packaging containers arranged in a row.
Figure 17:
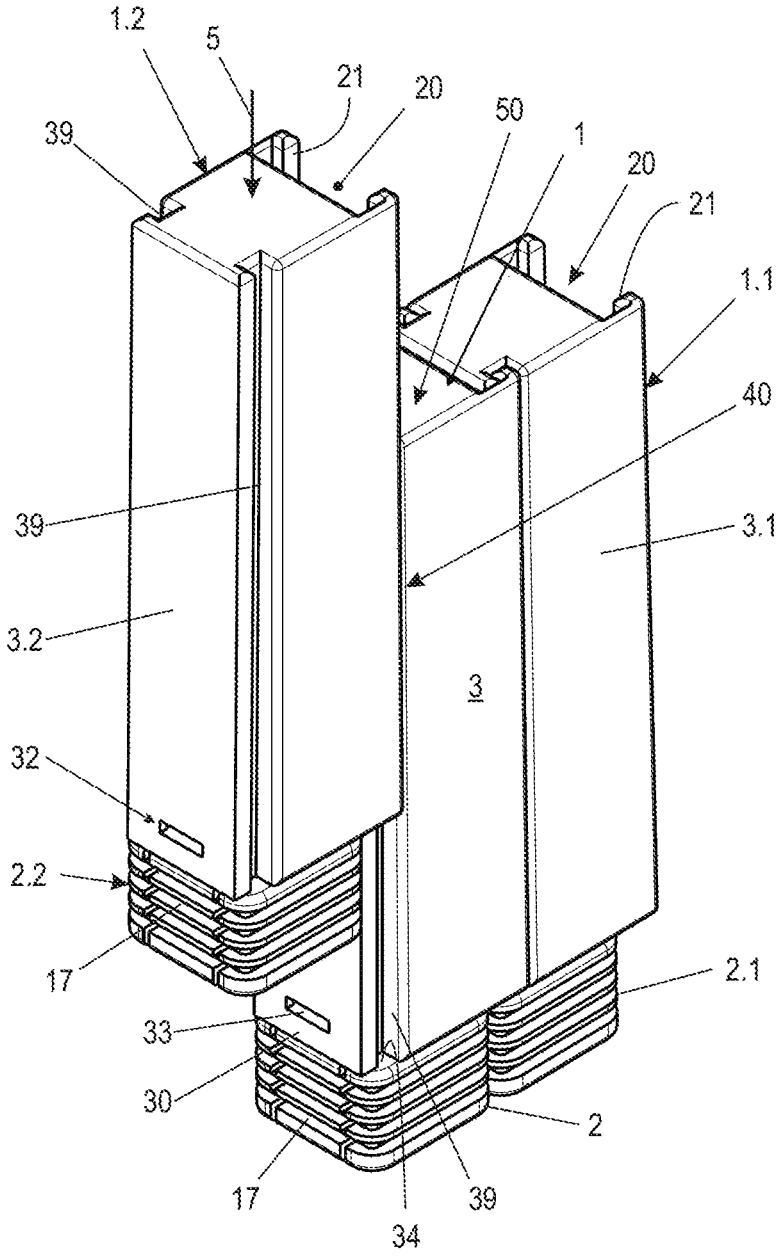
FIG. 17 is a perspective illustration of several packaging containers arranged in a row according to FIG. 16.
Figure 18:
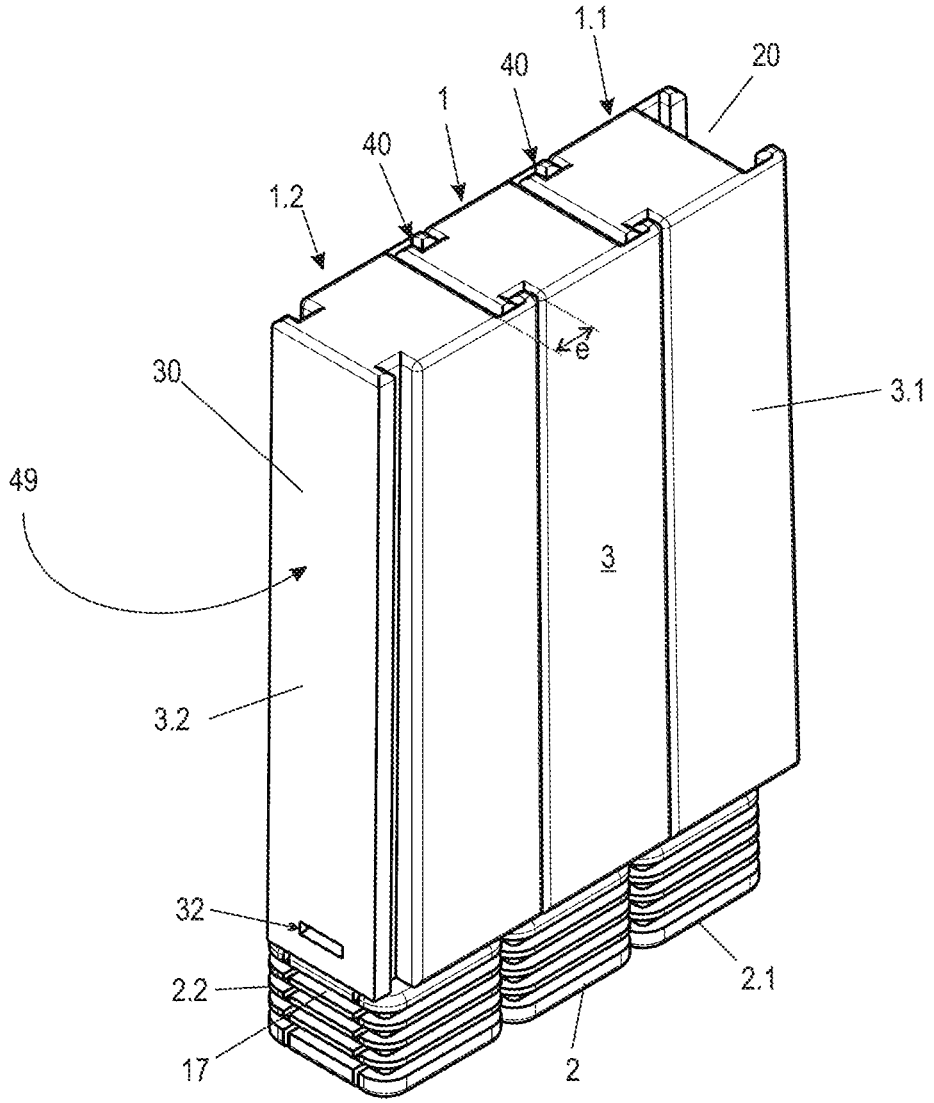
FIG. 18 is a perspective illustration of a row of three packaging containers arranged in a row.

The coupling device 40 is embodied as a sliding connection 50 which is slidable in the direction of the longitudinal axis 4 of the protective sleeve 3, as illustrated e.g. in FIG. 16.

Figure 7:
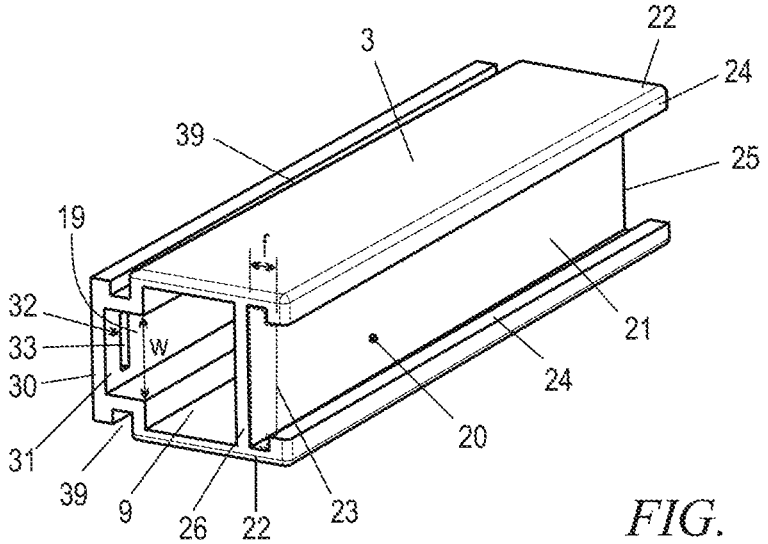
FIG. 7 is a perspective bottom view of the protective sleeve.

The primary part 20 is designed as a U-shaped receiving groove 21 wherein the free ends 24 of the outer legs 22 of the receiving groove 21 are angled toward to each other. This provides a T-like receiving profile 23, as shown in FIG. 7.

Figure 8:
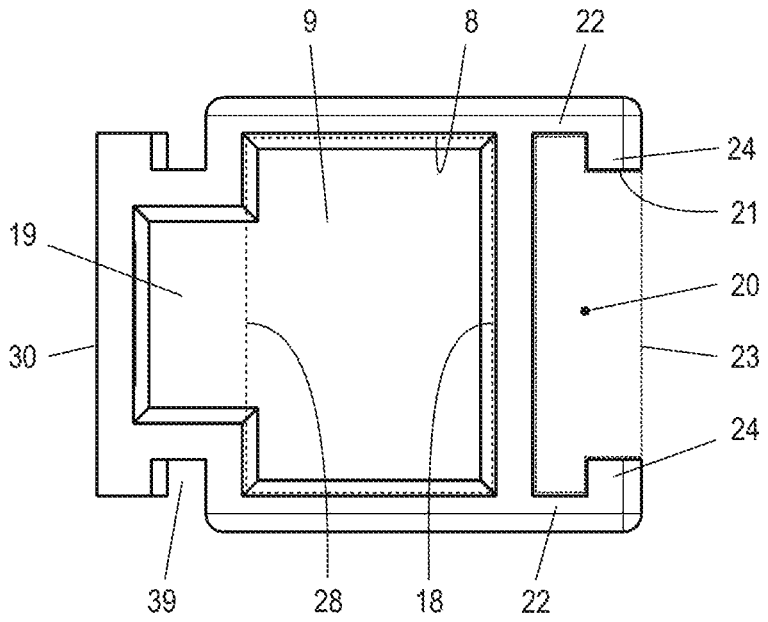
FIG. 8 is a bottom view of the protective sleeve.
Figure 9:
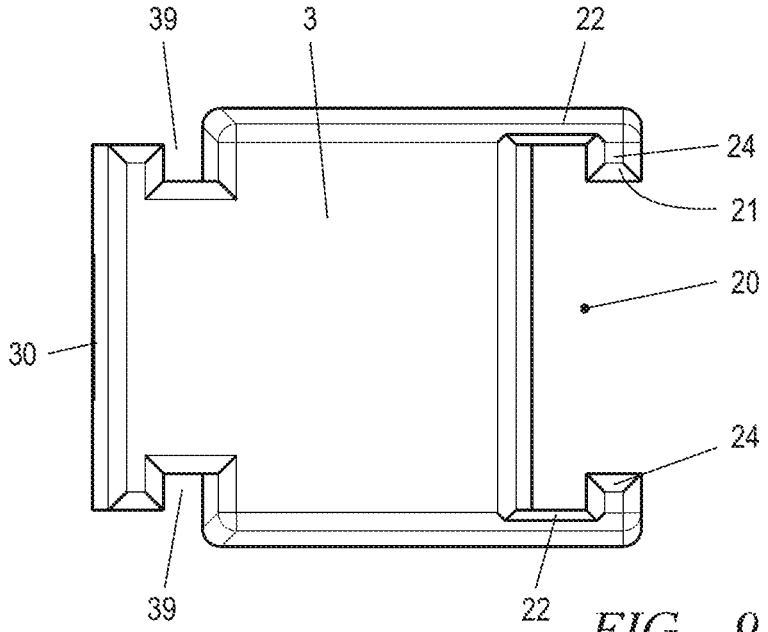
FIG. 9 is a plan view of the protective sleeve according to FIG. 5.
Figure 10:
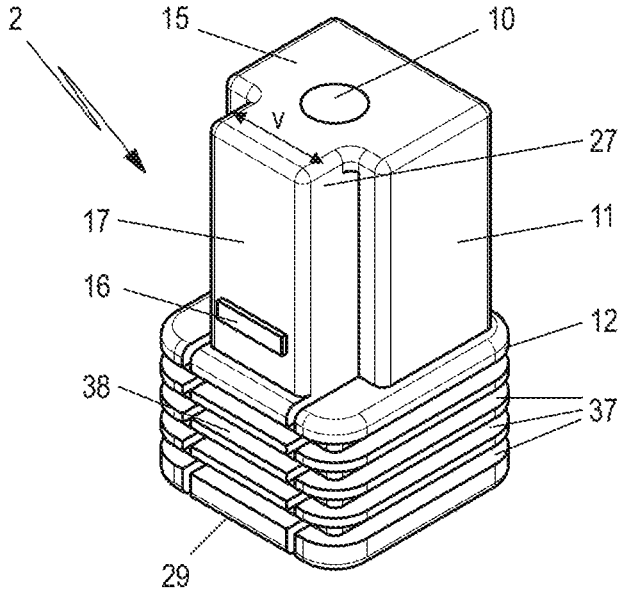
FIG. 10 is a perspective view of the base of the packaging container according to FIG. 1.
Figure 11:
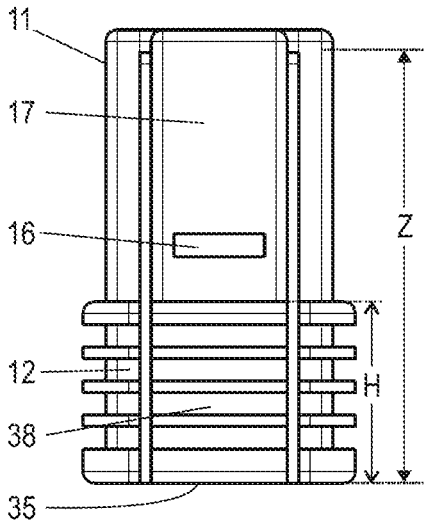
FIG. 11 is a view of the locking element of the base according to FIG. 10.
Figure 12:
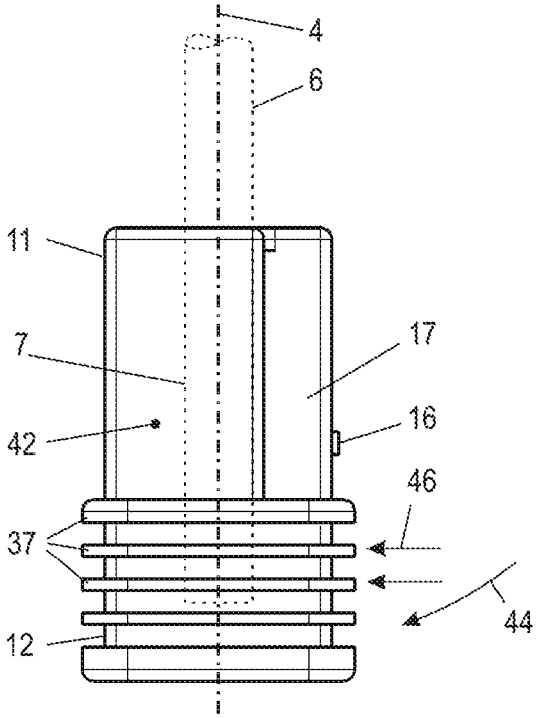
FIG. 12 is a side view of the base according to FIG. 10.
Figure 13:
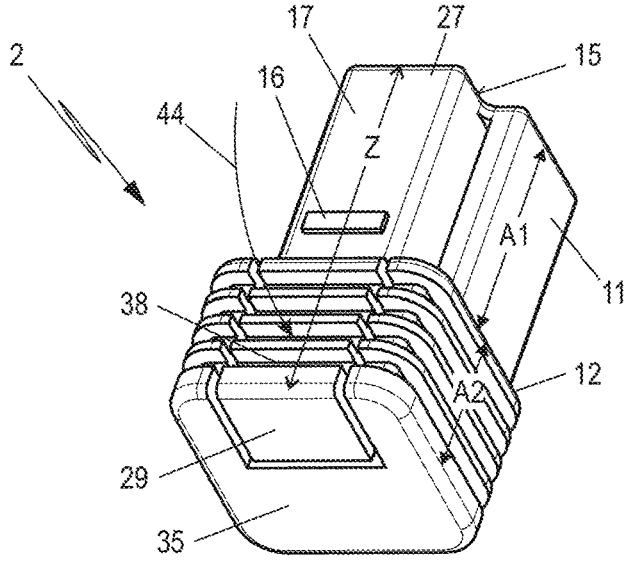
FIG. 13 is a perspective bottom view of the base with illustration of the locking tongue.

The secondary part 30 is embodied T-shaped in cross section and comprises two guide grooves 39 which are extending in the direction of the longitudinal axis 4, as illustrated in FIGS. 8 and 9. The cross section of the secondary part 30 corresponds to the receiving profile 23 of the receiving groove 21 of the primary part 20. In this way, as shown e.g. in FIG. 17, the primary part 20 of the coupling device 40 of the packaging container 1.2 can be pushed in the direction of longitudinal axis 4 of the packaging container 1.2 like a drawer onto the secondary part 30 of the packaging container 1.

The protective sleeve 3 is closed at its top end, as shown in FIG. 9. The bottom end of the protective sleeve 3 is open, as shown in FIG. 8. It is provided advantageously that the T-shaped profile of the secondary part 30 is partially hollow so that a receiving chamber 19 is formed adjacent to the cavity 9. As shown in FIG. 8, the receiving chamber 19 extends across the entire length S of the protective sleeve 3.

The receiving groove 21 of the primary part 20 is advantageously open at its end 25 and/or its end 26.

Due to the configuration of the primary part 20 as a receiving groove 21 with a T-shaped receiving profile 23 and the T-shaped profile of the secondary part 30, a sliding connection 50 like a drawer, a groove/sliding block connection or a dovetail connection is provided.

In the region of the bottom end 31 of the secondary part 30, a locking receptacle 32 is formed in the receiving chamber 19 and is preferably a locking slot 33.

As will be explained in detail in the following, the protective sleeve 3, after having been pushed onto the base 2, is locked thereat.

Figure 14:
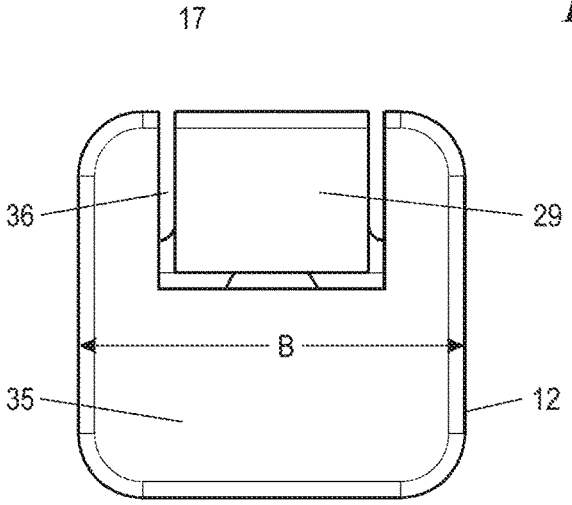
FIG. 14 is a bottom view of the base.
Figure 15:
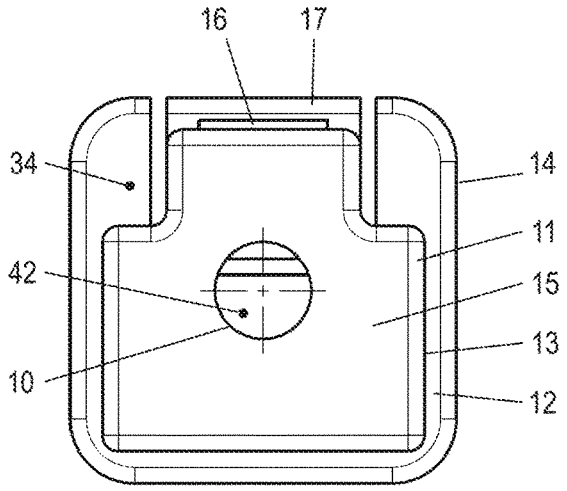
FIG. 15 is a plan view of the base with the receptacle formed therein.

The base 2 is illustrated in detail in FIGS. 10 to 15. It is comprised substantially of an insertion section 11 and a foot section 12. As shown in FIG. 15, the outer contour 13 of the insertion section 11 is located within the outer contour 14 of the foot section 12. In the illustrated embodiment, the base 2 or its foot section 12 form a stop 34 for the protective sleeve 3 when it is pushed on the insertion section 11.

The insertion section 11 and/or the foot section 12 are preferably hollow. The insertion section 11 has a top cover 15 in which preferably centrally a receptacle 10 is formed. In the illustrated embodiment, the receptacle 10 is circular; such a circular receptacle is in particular expedient for rotating tools. Other geometric shapes of the receptacle 10 may be expedient also.

The foot section 12 in the illustrated embodiment has a square basic shape with side length B; expediently, the foot section 12 can also have a rectangular shape or a shape deviating from a quadrangle.

At a side face of the base 2, a locking element 16 is formed. The locking element 16 is configured to be displaceable for locking engagement in the locking receptacle 32 of the protective sleeve 3. In the illustrated embodiment, a locking tongue 17 is provided which supports the locking element 16. The locking tongue 17 is preferably connected with one end 27 to the top cover 15. The other end 29 of the locking tongue 17 is expediently a free end. This is also illustrated in FIG. 14. The end 29 is embodied to be separate from (not connected to) the base bottom 35.

Between the end 29 of the locking tongue 17 and the base bottom 35 a gap 36 is formed. The end 29 of the locking tongue 17 is free. i.e., separate from the base bottom 35.

The locking tongue 17 extends with its tongue length Z across at least a length section A1 of the insertion section 11 and at least a length section A2 of the foot section 12. In the illustrated embodiment of FIG. 13, the locking tongue 17 with its tongue length Z extends across the height of the insertion section 11 and the height of the foot section 12 all the way to the base bottom 35. The locking tongue 17 has a width v that corresponds to the receiving width w of the receiving chamber 19 in the secondary part 30.

The foot section 12 comprises circumferentially extending ribs 37 for increasing grip of the base 2. In this way, it is ensured that the user can safely grip the foot section 12 and can reliably push down the end section 38 of the locking tongue 17 provided in the foot section 12. By pushing down the locking tongue 17, the locking element 16 is released from the locking receptacle 32 and the protective sleeve 3 is unlocked and released. The user can pull off the protective sleeve 3 from the base 2 so that the object, e.g. a tool, contained in the packaging container 1 becomes accessible.

As shown in FIGS. 1 through 4, the primary part 20 and/or the secondary part 30 of the protective sleeve 3 is projecting past the outer contour 14 of the foot section 12. In FIG. 2, it is illustrated that the primary part 20 of the coupling device 40 of the protective sleeve 3 projects past the outer contour 14 of the foot section 12 by a length of amount e. The amount of the projecting length e corresponds to the height f of the receiving profile 23 of the receiving groove 21 in the primary part 20. In this way, it is ensured, as shown in FIGS. 16 to 19, that several packaging containers 1, 1.1, 1.2 can be connected by the coupling device 40 to form a row 49 of packaging containers 1, 1.1, 1.2. In the embodiment, the outer surface 48 (FIG. 2) of the secondary part 30 is positioned in the same plane 45 as the side face 47 of the base 2. The bases 2, 2.1, 2.2 are positioned side-by-side adjacent to each other in a row 49. Since the projecting length e corresponds to the height f of the receiving profile 23, no slot is formed between the adjacently positioned bases 2, 2.1, 2.2. The bases 2, 2.1, and 2.2. form a continuous row, preferably without gap.

In addition to the detachable joining of packaging containers 1, 1.1, 1.2 in a row 49 in accordance with the invention, in the embodiment a further independent invention is shown. The receptacle 10 in the top cover 15 of the insertion section 11 opens into the hollow socket chamber 42, as shown in FIG. 15. The end 29 of the locking tongue 17 is displaced for release of the protective sleeve 3 in the direction of arrow 44 into the base chamber 42, in particular pivoted. An end 7 of the elongate object 6 inserted into the receptacle 10 is positioned in the base chamber 42. When the end section 38 of the locking tongue 17 is pushed down in the direction of arrow 44, the locking tongue 17 contacts as a clamping element the inserted end 7 of the object 6. When releasing the locking element 16 from the locking receptacle 32 of the protective sleeve 3, the locking tongue 17 exerts a clamping force 46 on the end 7 of the tool inserted into the base 2. When pushing down the locking tongue 17, the locking element 16 at its outer longitudinal side is displaced and lifted out of the locking receptacle 32. At the same time, a clamping element provided e.g. on the other inner longitudinal side of the locking tongue 17, or simply an inner locking tongue section, is pushed against the end 7 of the tool held in the receptacle 10 and thus exerts a clamping force 46.

In accordance with this independent invention, a packaging container for an elongate object 6, in particular for a tool such as a drill bit, a milling tool or the like is provided which is comprised of a base 2 and a protective sleeve 3 which, in direction 5 of the longitudinal axis 4 of the protective sleeve 3, can be pushed onto the base 2 and is held thereon. The base 2 comprises a receptacle 10 for an end 7 of the elongate object 6 wherein the protective sleeve 3 covers the elongate object 6. A locking tongue 17 is formed at the base 2 and provided with a locking element 16 which engages a locking receptacle 32 of the protective sleeve 3 wherein, for removing the protective sleeve 3 from the base 2, the locking element 16 is released from the locking receptacle 32 by pushing down the locking tongue 17. At the same time, the pushed-down locking tongue 17 exerts advantageously a clamping force 46 onto the end 7 of the elongate object 6 inserted into the base 2. In this way, it is ensured that upon opening of the packaging 1 the elongate object 6 cannot fall out in an uncontrolled way. This ensures that a sensitive tool cannot fall out even in a position of the packaging which is unfavorable during opening; thus, the tool is protected from becoming damaged.

The insertion section 11 is hollow and comprises a top cover 15 in which the receptacle 10 is formed. The base 2 is comprised of an insertion section 11 that is provided with the receptacle 10 and engaged by the protective sleeve 3 and of a foot section 12. The locking tongue 17 extends advantageously with its length Z across at least a length section A1 of the insertion section 11 and at least a length section A2 of the foot section 12. In particular, the locking tongue 17 with its length Z extends from the top cover 15 of the insertion section 11 all the way to the base bottom 35 of the foot section 12. Expediently, the receptacle 10 opens at a base chamber 42 wherein the locking tongue 17 projects into the base chamber 42. In particular, a tongue section of the locking tongue 17 is acting as a clamping element on an end 7 of the elongate object 6 inserted into the receptacle 10.

In FIGS. 20 to 23, a further embodiment of a packaging container 1, 1.1 according to the invention is illustrated, wherein the same parts are provided with the same reference characters as in the embodiment of FIG. 1.

The illustrated packaging containers 1 and 1.1 are of the same configuration and are comprised substantially of a protective sleeve 3 and a base 2, illustrated in FIGS. 24 to 27 in detail view. The protective sleeve 3 comprises a longitudinal axis 4 wherein the protective sleeve 3 can be pushed in direction of arrow 5 onto the base 2. The pushed-on protective sleeve 3 is preferably locked at the base 2.

Figure 20:
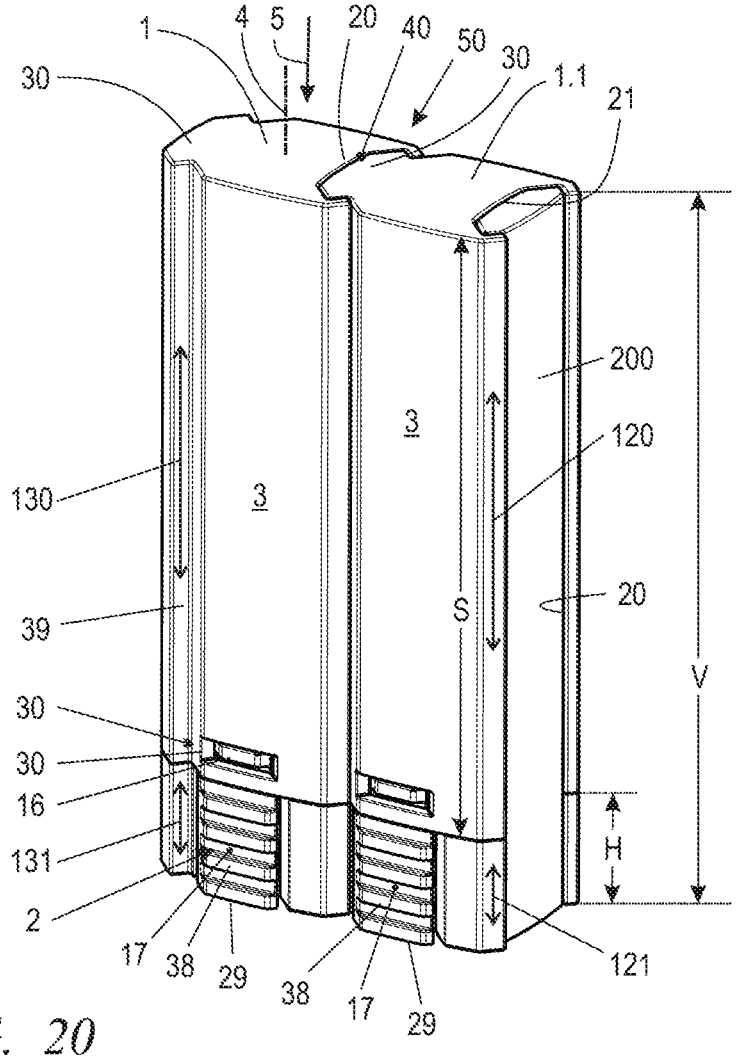
FIG. 20 is a perspective illustration of a further embodiment of a packaging container according to the invention with coupling device for connection with a second packaging container.
Figure 21:
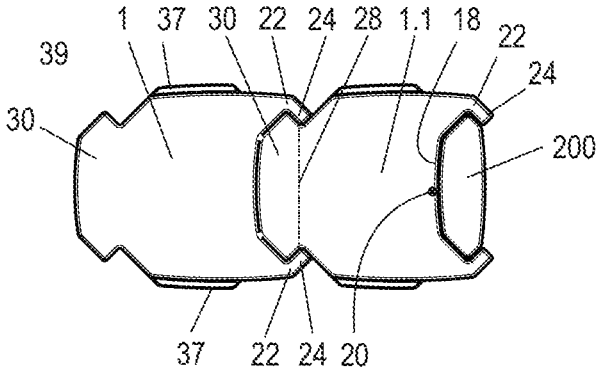
FIG. 21 is a plan view of two packaging containers according to FIG. 20 that are coupled to each other.
Figure 22:
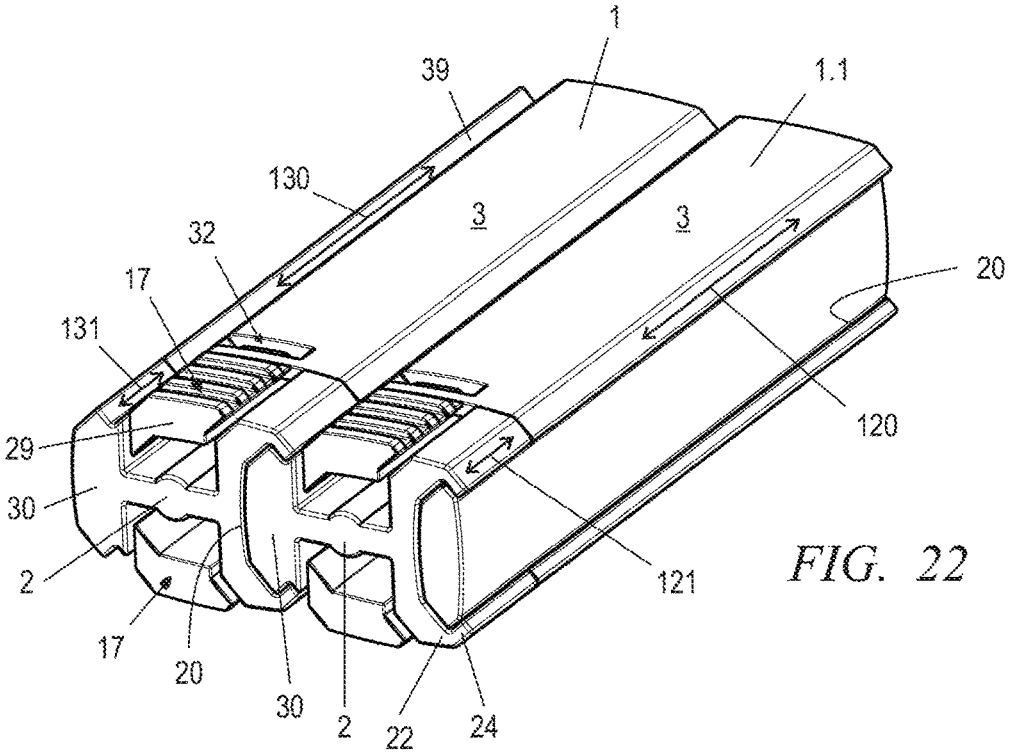
FIG. 22 is a perspective illustration of the base of two packaging containers according to FIG. 20 that are coupled to each other.

The packaging container 1 is provided, preferably at a first longitudinal side 18 (FIG. 21), with a primary part 20 that is part of the external coupling device 40 (FIG. 20). The primary part 20 forms a receptacle for a secondary part 30 of a further coupling device 40 of a packaging container to be connected. By means of the coupling device 40, the packaging containers 1, 1.1 can be detachably connected to each other.

As also shown in the embodiment according to FIGS. 1 to 19, a length section 120 of the primary part 20 extends advantageously across the entire length S of the protective sleeve 3. Accordingly, a first length section 130 of the secondary part 30 of the coupling device 40 extends across the entire length S of the protective sleeve 3.

The coupling device 40 is embodied as a sliding connection 50 which is slidable in the direction of the longitudinal axis 4 of the protective sleeve 3. The sliding connection can be embodied like a groove/sliding block connection or a dovetail connection.

Figure 24:
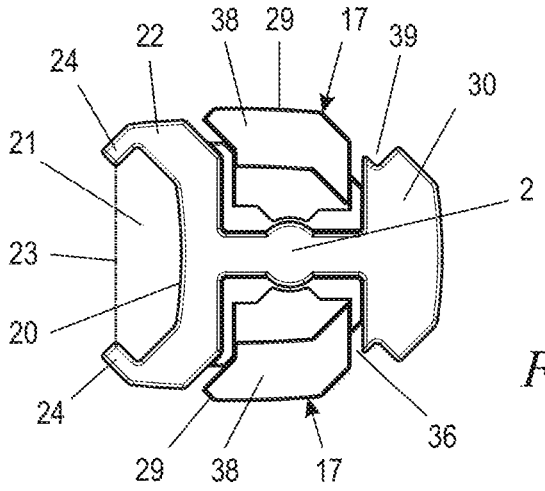
FIG. 24 is an enlarged view of the bottom of the base according to FIG. 22.
Figure 25:
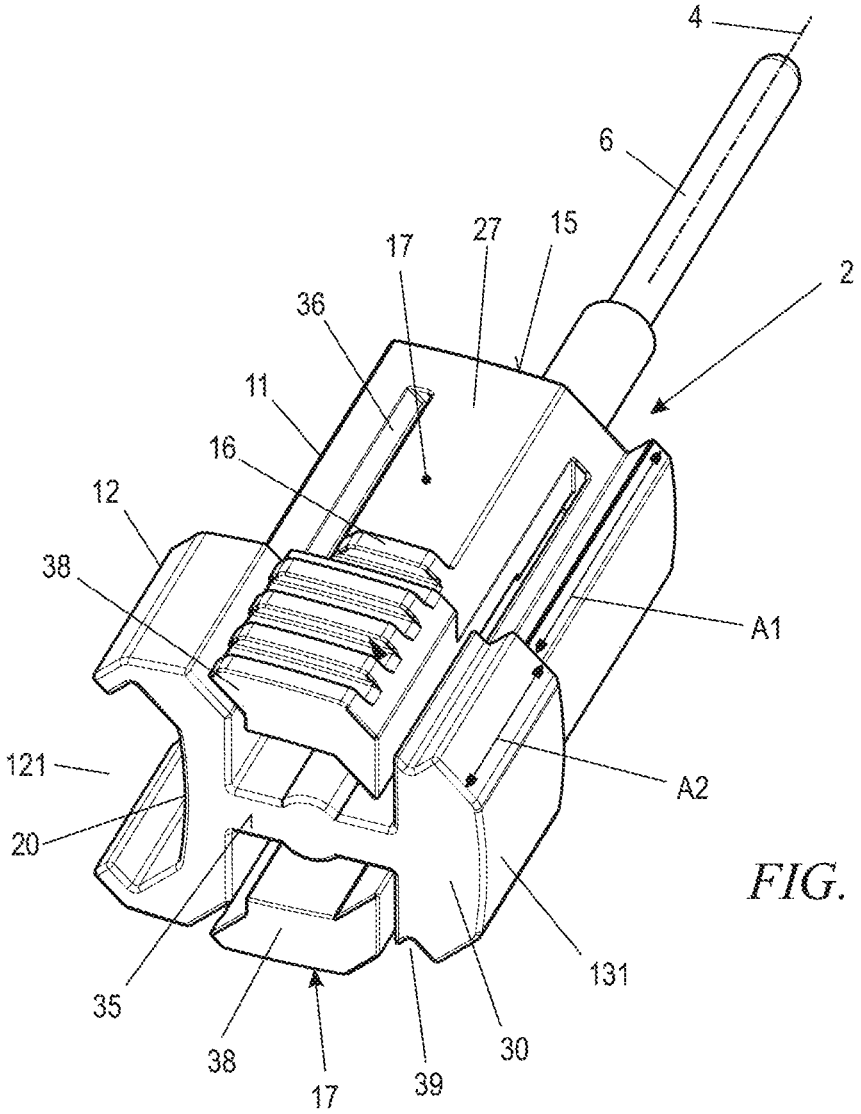
FIG. 25 is a perspective illustration of the base with locking tongue and with an elongate object held in the base.
Figure 26:
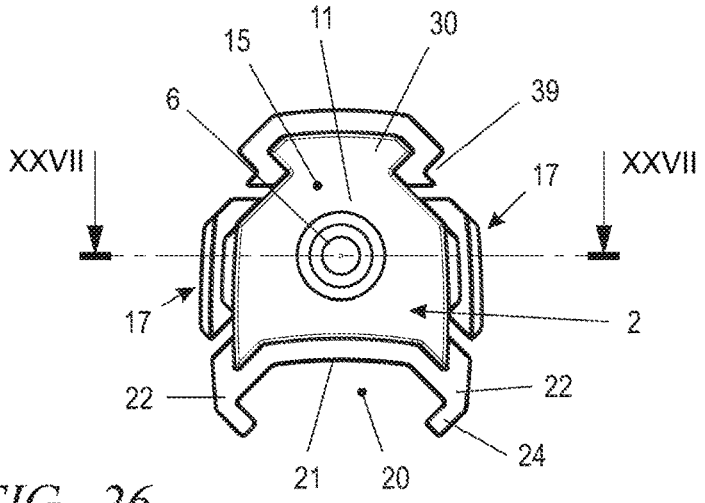
FIG. 26 is a top plan view of the base according to FIG. 25.

As illustrated also in the first embodiment, the primary part 20 is embodied as a U-shaped receiving groove 21 wherein the free ends 24 of the outer leg 22 of the receiving groove 21 are angled toward each other. In this way, a T-like receiving profile 23 as shown e.g. in FIG. 24 is provided.

Figure 23:
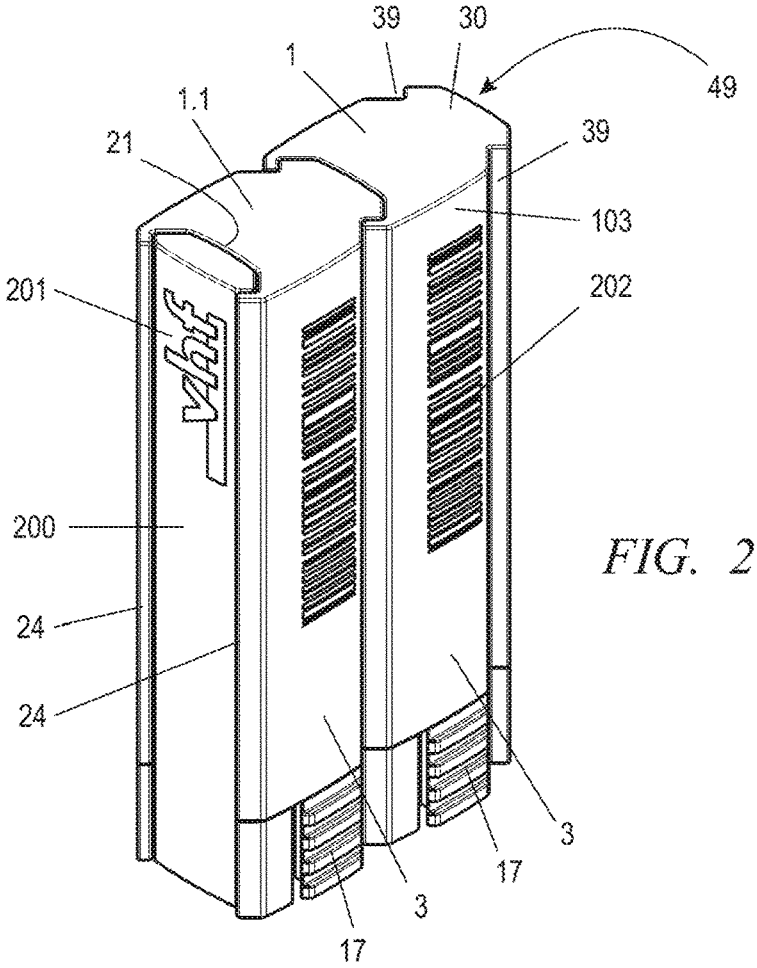
FIG. 23 is a perspective illustration of two packaging containers according to FIG. 20 coupled to each other and provided with a barcode applied laterally on the protective sleeve and an inserted emblem carrier.

The secondary part 30 is T-shaped in cross section and comprises two lateral guide grooves 39 which are extending in the direction of the longitudinal axis 4, as shown in particular in FIGS. 20 to 23. The cross section of the secondary part 30 corresponds to the profile of the receiving groove 21 of the primary part 20. The secondary part 30 of the packaging container 1.1 (FIG. 20) can be pushed in direction of arrow 5 in the direction of the longitudinal axis 4 similar to a drawer into the receiving profile of the primary part 20 of the packaging container 1. The packaging containers can be assembled in a row 49 adjacent to each other, as shown in FIG. 23.

In FIGS. 20 to 23, a fill member 200 is illustrated which corresponds to the profile of the secondary part 30 and is inserted into the receiving groove 21 of a first packaging container 1.1. The fill member 200 can be embodied as an emblem carrier with an emblem 201 so that a row 49 of packaging containers can be marked at the end face of the row. As a supplement or an alternative, at a side face 103 of the protective sleeve 3 an electronic marking can be provided, e.g. a barcode 202 (FIG. 23).

In the embodiment according to FIGS. 20 to 27, a further length section 121 of the primary part 20 is provided at the base 2 of the packaging container 1 or 1.1. The length section 120 of the primary part 20 at the protective sleeve 3 is expediently supplemented by the length section 121 of the base 2. The length section 121 of the primary part 20 extends advantageously across the entire height H of the foot section 12 of the base 2. Advantageously, the primary part 20 extends thus across the entire length V (FIG. 20) of the packaging container 1.

Correspondingly, a first length section 130 of the secondary part is supplemented by a further length section 131 at the base 2. The first length section 130 extends across the entire length S of the protective sleeve 3; the further second length section 131 extends across the entire height H of the foot section 12 of the base 2. The first length section 130 is supplemented by the second length section 131 so that the secondary part 30 extends across the entire length V of the packaging container 1.

The base 2 is shown in detail in FIGS. 24 to 27. As in the first embodiment, it is comprised of an insertion section 11 and a foot section 12 wherein, in plan view according to FIG. 26, the outer contour of the insertion section 11 is located within the outer contour of the foot section 12.

The insertion section 11 comprises a top cover 15 and at least one locking tongue 17 extends in the direction toward the base bottom 35 away from the top cover 15. In the illustrated embodiment, the locking tongue 17 with its upper end 27 adjoins the top cover 15 while the other end 29 forms a free end. The free end 29 ends at the base bottom 35. In the illustrated embodiment, the base 2 has two locking tongues 17 which are diametrically opposed to each other relative to longitudinal axis 4 of the packaging container 1.

Figure 27:
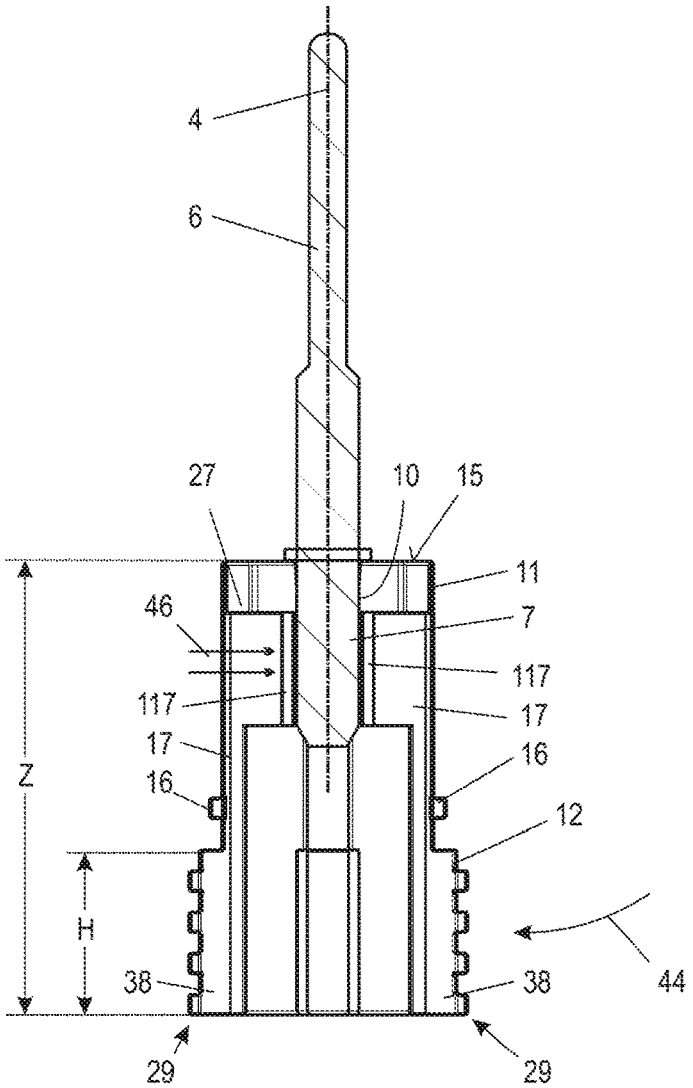
FIG. 27 is a section through the base along section line XXVII-XXVII in FIG. 26.

As is apparent from the section illustration of FIG. 27, the locking tongue 17 at its outer longitudinal side comprises the locking element 16 which has correlated therewith a locking receptacle 32 provided in the protective sleeve 3 and embodied as a locking slot 33. In the region of the end 27 of the locking tongue 17 adjoining the cover top 15, a clamping element 117 is provided which is arranged at the inner longitudinal side of the locking tongue 17 and is facing the inserted end 7 of the tool. When the free end 29 of the locking tongue 17 is pushed down in direction of arrow 44, the locking element 16 is displaced and is moved out of the locking receptacle 32 so that the protective sleeve 3 can be removed; at the same time, the clamping element 117 provided at the locking tongue 17 is pushed against the end 7 of the tool so that a clamping force 46 is exerted which secures the tool in the receptacle 10 by clamping action.

As shown in FIG. 27, the locking element 16 is positioned between the end 27 of the locking tongue 17 connected to the top cover 15 and the free end 29 of the locking tongue 17. The clamping element 117 is provided in the region of the connected end 27. The locking element 16 is positioned between the clamping element 117 and the free end 29 of the locking tongue 17.

The specification incorporates by reference the entire disclosure of German priority document 10 2017 009 135.8 having a filing date of Sep. 28, 2017.

While specific embodiments of the invention have been shown and described in detail to illustrate the inventive principles, it will be understood that the invention may be embodied otherwise without departing from such principles.

What is claimed is:

1. A packaging container for an elongate object, the packaging container comprising:

a base;

a protective sleeve configured to be pushed in a direction of a longitudinal axis of the protective sleeve onto the base and configured to be secured at the base;

wherein the base comprises a receptacle configured to hold an end of an elongate object and the protective sleeve covers an elongate object received in the receptacle;

wherein the packaging container comprises a primary part of a first external coupling device configured to detachably connect to a secondary part of a second external coupling device provided on a further packaging container;

wherein the protective sleeve is configured to lock at the base;

wherein the base comprises at least one locking tongue with a locking element;

wherein the protective sleeve comprises a locking receptacle and wherein the locking element engages the locking receptacle of the protective sleeve to lock the protective sleeve at the base;

wherein the at least one locking tongue, when the locking element is released from the locking receptacle of the protective sleeve, moves into a contact position at an end of an elongate object held in the receptacle and exerts in the contact position a clamping force on the end of the elongate object.

2. The packaging container according to claim 1, wherein the packaging container comprises a first longitudinal side and a second longitudinal side, wherein the primary part of the first external coupling device is arranged at the first longitudinal side and a secondary part of the first external coupling device is arranged at the second longitudinal side.

3. The packaging container according to claim 2, wherein the first longitudinal side and the second longitudinal side are parallel to each other.

4. The packaging container according to claim 2, wherein at least one of a first length section of the primary part of the first external coupling device and a first length section of the secondary part of the first external coupling device is formed on the protective sleeve.

5. The packaging container according to claim 4, wherein at least one of a second length section of the primary part of the first external coupling device and a second length section of the secondary part of the first external coupling device is formed on the base.

6. The packaging container according to claim 2, wherein at least one of the primary part of the first external coupling device and the secondary part of the first external coupling device extends across an entire length of the packaging container.

7. The packaging container according to claim 2, wherein at least one of the primary part of the first external coupling device and the secondary part of the first external coupling device projects past an outer contour of the base.

8. The packaging container according to claim 1, wherein the first external coupling device is a sliding connection configured to slide in the direction of the longitudinal axis of the protective sleeve.

9. The packaging container according to claim 8, wherein the sliding connection is a groove and sliding block connection or a dovetail connection.

10. The packaging container according to claim 1, wherein the receptacle opens into a base chamber of the base and wherein the at least one locking tongue projects into the base chamber.

11. The packaging container according to claim 1, wherein the at least one locking tongue comprises a tongue section, wherein the tongue section acts as a clamping element on the end of the elongate object.

12. The packaging container according to claim 1, wherein the base is comprised of an insertion section engaged by the protective sleeve and further comprised of a foot section, wherein the receptacle is provided in the insertion section, wherein the at least one locking tongue comprises a length and said length extends at least across a length section of the insertion section and at least across a length section of the foot section.

13. The packaging container according to claim 12, wherein the at least one locking tongue extends from the insertion section all the way to a base bottom of the base.

14. The packaging container according to claim 1, wherein the base is comprised of an insertion section engaged by the protective sleeve and further comprised of a foot section, wherein the receptacle is provided in the insertion section, wherein in a plan view of the base an outer contour of the insertion section is located within an outer contour of the foot section, wherein the outer contour of the foot section is larger than the outer contour of the insertion section.

15. The packaging container according to claim 1, wherein the base comprises a stop for the first external coupling device.

16. The packaging container according to claim 1, wherein two of said locking tongue are provided, wherein said two locking tongues are arranged diametrically opposed to each other relative to a longitudinal axis of the packaging container.

17. The packaging container according to claim 16, wherein said two locking tongues each comprise a clamping element configured to clamp the end of the elongate object, wherein the clamping element is arranged at an inner longitudinal side of said locking tongues, respectively, and is facing the end of the elongate object, wherein said two locking tongues each comprise a free end, and wherein, by pushing together the free ends, the clamping elements exert the clamping force and secure the end of the elongate object through the clamping force.

18. The packaging container according to claim 17, wherein, when pushing together the free ends, the locking element is released from the locking receptacle of the protective sleeve for pulling off the protective sleeve and simultaneously the clamping elements of said two locking tongues are pushed against the end of the elongate object to exert the clamping force.

* * * * *